US010035674B2

(12) United States Patent
Sherrill

(10) Patent No.: US 10,035,674 B2
(45) Date of Patent: Jul. 31, 2018

(54) APPARATUS FOR PROTECTING AND DISPENSING PAPER PRODUCTS

(71) Applicant: William Tobias Sherrill, Greensboro, NC (US)

(72) Inventor: William Tobias Sherrill, Greensboro, NC (US)

( * ) Notice: Subject to any disclaimer, the term of this patent is extended or adjusted under 35 U.S.C. 154(b) by 398 days.

(21) Appl. No.: 14/749,023

(22) Filed: Jun. 24, 2015

(65) Prior Publication Data

US 2016/0374521 A1 Dec. 29, 2016

(51) Int. Cl.

| | |
|---|---|
| ***A47K 10/40*** | (2006.01) |
| ***B65H 16/00*** | (2006.01) |
| ***B65H 16/02*** | (2006.01) |
| ***A47K 10/38*** | (2006.01) |

(52) U.S. Cl.

CPC ..... *B65H 16/028* (2013.01); *A47K 10/3827* (2013.01); *B65H 16/005* (2013.01)

(58) Field of Classification Search

CPC . B65H 16/028; B65H 16/005; A47K 10/3827
See application file for complete search history.

(56) References Cited

U.S. PATENT DOCUMENTS 1,857,523 A 5/1932 Wittel
1,915,736 A 6/1933 Hurlbut
3,405,983 A * 10/1968 Rutz ..... A61F 15/002 242/588.2
3,687,386 A * 8/1972 Sandbach ..... B41L 5/10 242/419.4
4,167,253 A * 9/1979 Rutz ..... A61F 15/002 242/419
5,105,604 A * 4/1992 Harris ..... G03B 27/588 53/409
5,551,646 A * 9/1996 Goldstein ..... B26B 27/00 225/56
5,639,043 A * 6/1997 Baird ..... B65H 59/02 242/125.3
6,113,026 A * 9/2000 Pottorff ..... B29C 55/08 226/196.1
7,255,303 B2 * 8/2007 Jenrick ..... G07F 11/68 242/548
2004/0004013 A1 1/2004 Dleter et al.
2011/0017765 A1 1/2011 Mallard et al.

* cited by examiner

*Primary Examiner* — William A. Rivera
(74) *Attorney, Agent, or Firm* — Moore & Van Allen PLLC; Nicholas C. Russell

(57) ABSTRACT

An apparatus for protecting and dispensing sheet material comprised of a semi-flexible sheet is disclosed. The semi-flexible sheet may be radially collapsed into a cylindrical shape to cover and protect a roll of sheet material. The semi-flexible sheet comprises a leading end and a distal end. When the semi-flexible sheet is radially collapsed over the roll of sheet material, the leading end covers the distal end and a portion of the semi-flexible sheet creating a gap, the sheet may be positioned in the gap created and allows the sheet material to pass between the leading end and the distal end for dispensing. The semi-flexible sheet may continue to radially collapse via the use of attachment mechanisms, as the sheet material is dispensed, applying pressure to the roll of sheet material. The semi-flexible sheet may further comprise a gripping surface located along the leading end to cut sheet material when necessary.

19 Claims, 16 Drawing Sheets

APPARATUS FOR PROTECTING AND DISPENSING PAPER PRODUCTS

BACKGROUND

Paper products and other paper product have been manufactured to be stored and dispensed in a rolled form. Typically, disposable paper products are wrapped in a roll form around a tube. In this way, depending on the amount of product wrapped around the roll, the various rolls may come in a variety of sizes, including length and circumference, depending on the paper product being dispensed, such as toilet paper, paper towels, or the like. Rolls allow for a compact packaging of long lengths of the paper products and dispensing of the same. However, the rolled design does not provide protection to the paper product on the roll. The material, especially the outer layer, is exposed to the elements, including water, which may hinder the performance of the paper product. As such, there exists a need for developing a paper product dispenser that provides adequate protection to the paper product.

BRIEF SUMMARY

The following presents a simplified summary of several embodiments of the invention relating to an apparatus for protecting and dispensing paper product and namely disposable paper products.

Embodiments of the invention include an apparatus comprising semi-flexible sheet of plastic material that is capable of being radially collapses into a cylindrical shape around a roll of disposable paper products. The semi-flexible plastic sheet includes at least a leading end, a distal end, a first side edge, and a second side edge. As the semi-flexible plastic sheet radially collapses into the cylindrical shape of the roll comprising the paper product, the leading end overlays the distal end and at least a portion of the semi-flexible sheet. The overlaid leading end and the distal end form a small slit or gap between two faces of the semi-flexible sheet that allows the paper products from the roll to be dispensed through the gap.

The ability for the apparatus to radially collapse upon the paper product on the roll causes the apparatus to uniformly compress the paper product. Thus, the apparatus always provides adequate pressure to and remaining in contact with the paper product. In addition, the apparatus provides protection for the paper product.

In some embodiments, the invention comprises an apparatus for protecting and dispensing sheet material, the apparatus comprising a semi-flexible sheet having: a leading end and a distal end, wherein the semi-flexible sheet is partially tapered in width from the leading end to the distal end; a first side edge and a second side edge, wherein the first side edge and the second side edge comprise attachment means adjacent to the leading end for releasably attaching a portion of the semi-flexible sheet, wherein the semi-flexible sheet is radially collapsible upon a roll of sheet material such that the first side edge and the second side edge form a cylindrical shape about the roll of sheet material, wherein upon radially collapsing upon the roll of sheet material the leading end overlays the distal end and a portion of the semi-flexible sheet such that a portion of the roll of sheet material is compressed between the overlaid leading end and distal end.

In some embodiments, the attachment means comprises a J shaped clip, wherein one clip is connected to the first side edge proximate to the leading end and a second clip is connected to the second side edge proximate to the leading end, wherein the clips are directed inward towards the semi-flexible sheet to receive and releasably attached the first side edge and the second side edge proximate to the distal end.

In some embodiments, a height of the leading end of the semi-flexible sheet is at least equal to or greater than a height of the roll of sheet material, and wherein the height of the distal end is at least equal to or less than the height of the leading end.

In some embodiments, the semi-flexible sheet further comprises at a first end cover attached perpendicularly to the first side edge and a second end cover attached perpendicularly to the second side edge, wherein the first and second end cover covers at least a portion of an end of a roll of sheet material, wherein the first and second end cover comprises angled spaces configured to prevent the end cover from binding when the semi-flexible sheet is radially collapsed.

In some embodiments, the semi-flexible sheet further comprises ribs that are positioned on at least one surface of the semi-flexible sheet, wherein the ribs are positioned to inhibit axial travel of the roll of sheet material and allow the sheet material to be dispensed.

In some embodiments, the length of the semi-flexible sheet from the distal end to the leading end is greater than a circumference of the roll of sheet material.

In some embodiments, the semi-flexible sheet comprises a plastic material.

In some embodiments, the semi-flexible sheet further comprises a notch located on the leading end, wherein the notch allows for grasping of the sheet material compressed between the overlay created by the leading end and the distal end, and wherein when the semi-flexible sheet is radially collapsed, the notch reveals the sheet material.

In some embodiments, the leading end of the semi-flexible sheet further comprises a gripping surface directed towards the sheet material when the semi-flexible sheet is radially collapsed, wherein the gripping surface is a series of serrations. In some embodiments, the gripping surface allows passage of the sheet material past the gripping edge when force is applied to the sheet material perpendicular to a front surface of the leading end, and wherein the gripping surface grips the sheet material when force is applied to the sheet material perpendicular to the leading end.

In some embodiments, the sheet material is a disposable paper product.

In some embodiments, the apparatus provides environmental protection to the roll of sheet material, wherein environmental protection comprises at least moisture protection, dust protection, and abrasion protection.

The features, functions, and advantages that have been discussed may be achieved independently in various embodiments of the present invention or may be combined with yet other embodiments, further details of which can be seen with reference to the following description and drawings.

BRIEF DESCRIPTION OF THE DRAWINGS

The accompanying drawings are incorporated into the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF EMBODIMENTS OF THE INVENTION

Figure 1A:
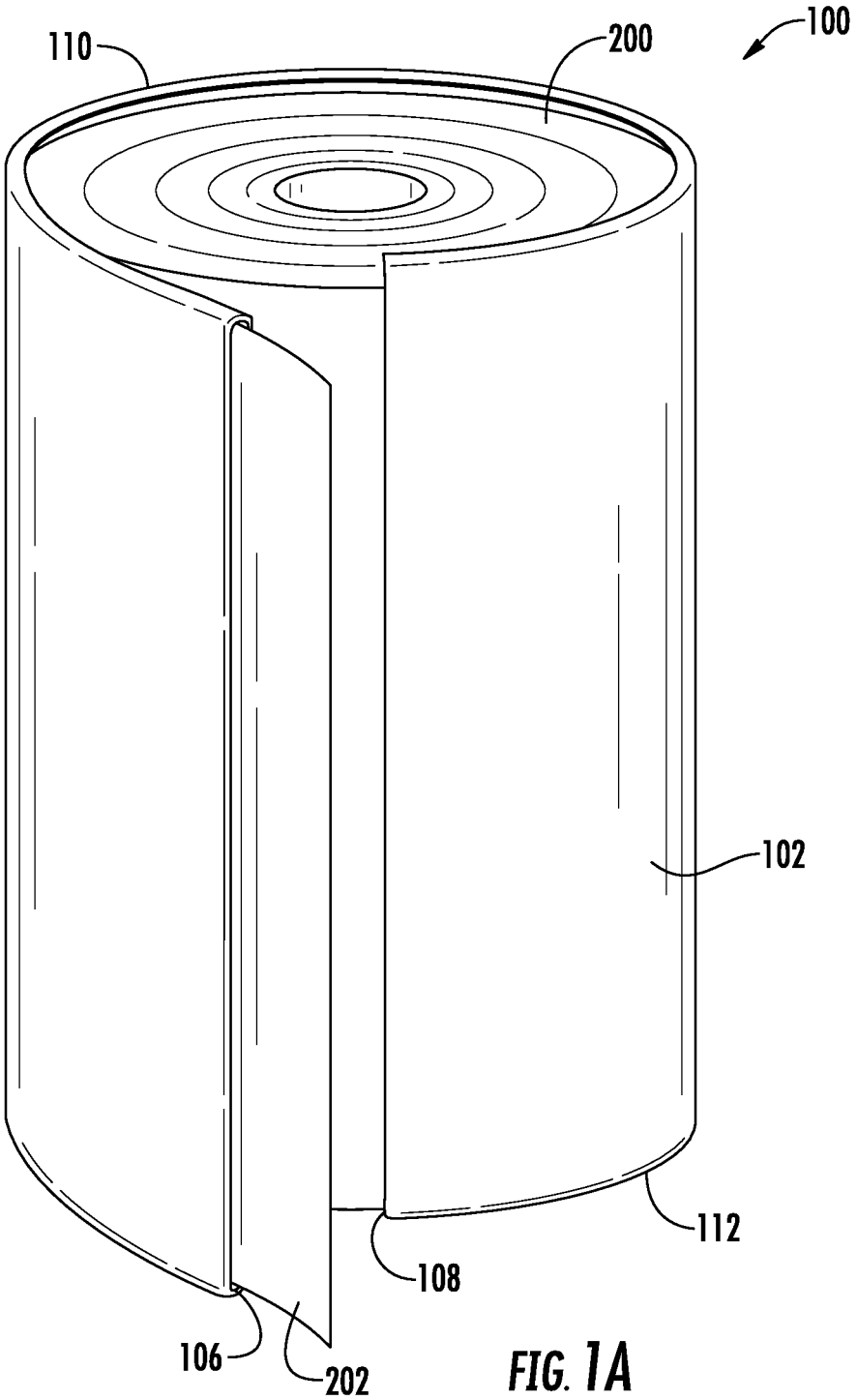
FIG. 1A is a perspective view of a first embodiment of the apparatus, in accordance with one embodiment of the present invention.

The present inventions are described in the following by referring to drawings of examples of how the inventions can be made and used. In these drawings, reference characters are used throughout to indicate like or corresponding parts. The embodiments shown are described herein are exemplary. Many details that are well known in the art are neither shown nor described.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to elements throughout. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Furthermore, the term paper products may include one or more other types of sheet material, such as cloth, steal, cardboard, or the like.

While the foregoing disclosure discusses illustrative embodiments, it should be noted that various changes and modifications could be made herein without departing from the scope of the described aspects and/or embodiments as defined by the appended claims. Furthermore, although elements of the described aspects and/or embodiments may be described or claimed in the singular, the plural is contemplated unless limitation to the singular is explicitly stated. Additionally, all or a portion of any embodiment may be utilized with all or a portion of any other embodiment, unless stated otherwise.

Embodiments of the invention relate to methods and apparatuses for protecting and dispensing a roll of sheeted material, namely disposable paper product material.

The invention may hold any type of rolled paper product where the paper product is formed in a cylindrical roll or other shape. Typically, the roll of paper product comprises a core (e.g. a cardboard roll) upon which the paper product is wound. The core may be a cylinder with two open ends. The paper product may consist of, but is not limited to, paper products, fabric, sheet metal, sheet composites, other sheet type material, and the like. For simplicity, herein the term "paper product" may include one or more of the above paper products. The roll of paper product may have a large diameter when full and a continually decreasing diameter upon use of the paper product. As such, as material is dispensed from the roll of paper product, the diameter of the roll reduces. Additionally, the roll of paper product may also have a given height that remains consistent regardless of the capacity of the roll. However, the height may change depending on the type of paper product on the roll, such as paper towels, toilet paper, napkins, drawing paper, cardboard, steel rolls, or the like.

FIG. 1A illustrates a prospective view of the apparatus 100. The apparatus includes a semi-flexible sheet 102. The semi-flexible sheet 102 is generally made of a semi-ridged plastic type material. In some embodiments, the semi-flexible sheet 201 may be made with a plurality of materials, such as plastic, composite material, metal, or combination thereof. In some embodiments, when the semi-flexible sheet 102 is made of plastic, the plastic may be a polyvinyl chloride.

The semi-flexible sheet 102 comprises a leading end 106, a distal end 108, a first side edge 110, and a second side edge 112. The semi-flexible sheet 102 is manufactured such that it is capable of being radially collapsible into a cylindrical shape or other shape over a roll of paper product 200. As illustrated, the roll of paper product 200 includes an inner core 204. In this way, the semi-flexible sheet 102 provides a spring like force upon radially collapsing that provides an inward tension onto the roll of paper product 200. Thus, completely surrounding the sides of the paper product and providing protection to the paper products. When the semi-flexible sheet 102 is radially collapsed into a cylindrical shape, the leading end 106 overlays the distal end 108 and a portion of the semi-flexible sheet 102. The leading end 106, the distal end 108, and the portion of the semi-flexible sheet 102 form a gap or slit longitudinally along the edge, that allows a single sheet or a portion of a single sheet of the paper product 202 to be positioned between the leading end and the distal end 108. In this way, allowing the paper product to be dispended from the apparatus.

In some embodiments, the corners formed by the first side edge 110, the second side edge 112, the leading end 106, and the distal end 108 may be rounded.

In other embodiments, the first side edge 110 and the second side edge may curved such that a portion of the first side edge 110 and the second side edge 120 cover a second portion of the first side edge 110 and the second side edge 120, thereby interlocking the portions of the first side edge 110 and the second side edge 120 which prevents movement of the semi-flexible sheet.

Figure 1B:
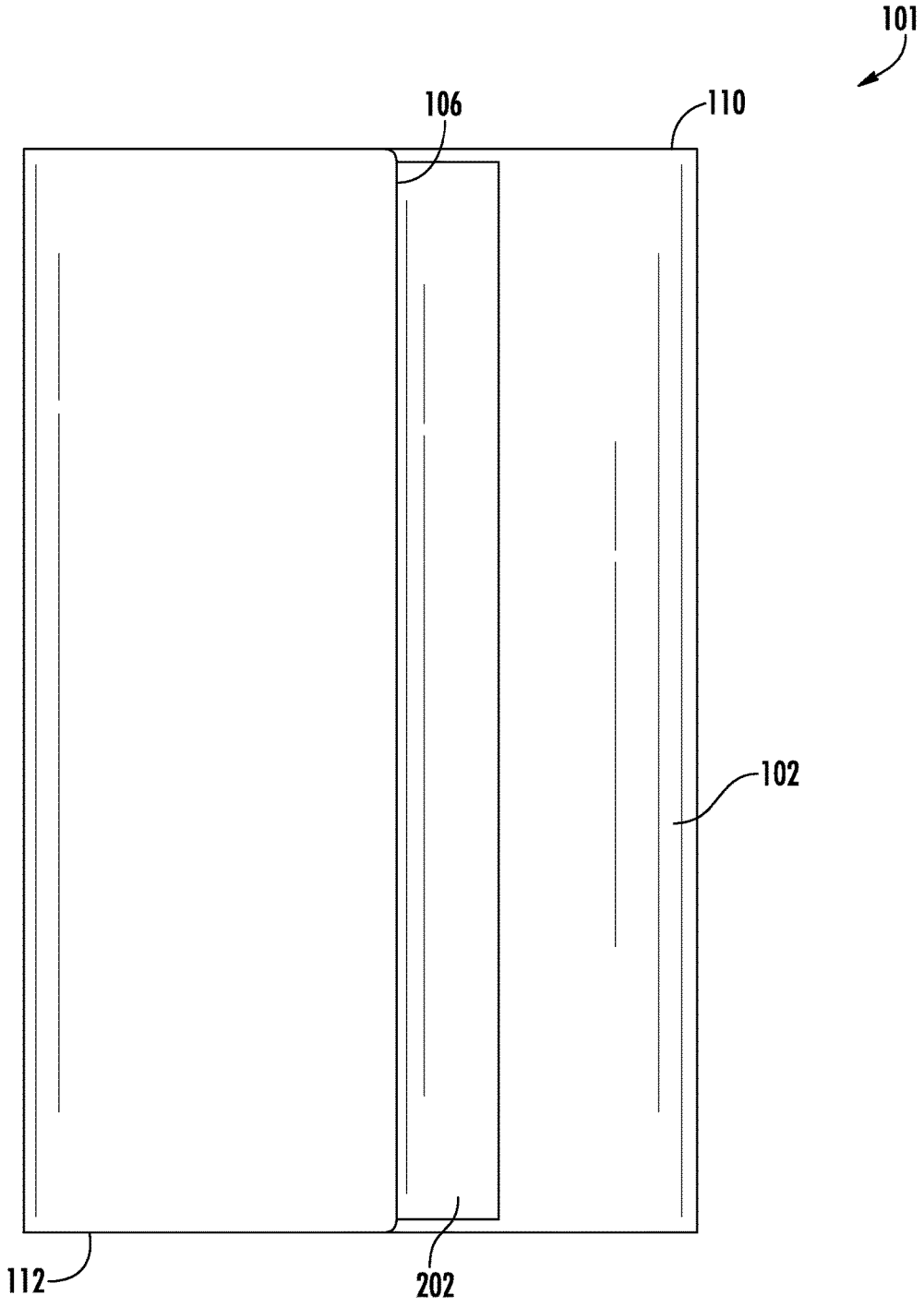
FIG. 1B is a side view of an embodiment of the apparatus including paper product, in accordance with one embodiment of the present invention.

FIG. 1B illustrates a side view of the apparatus 101. As illustrated in FIG. 1B, the semi-flexible sheet 102 with a leading end 106, a distal end 108, a first side edge 110, and a second side edge 112 is illustrated. The semi-flexible sheet 102, as shown, is radially collapsed onto a roll of paper product 200. As illustrated, the semi-flexible sheet 102 is completely surrounding the sides of the paper product and providing protection to the paper products. As illustrated in FIG. 1B, when the semi-flexible sheet 102 is radially collapsed into a cylindrical shape, the leading end 106 overlays the distal end 108 and a portion of the semi-flexible sheet 102. The leading end 106, the distal end 108, and the portion of the semi-flexible sheet 102 form a gap or slit longitudinally along the edge, that allows a single sheet or a portion of a single sheet of the paper product 202 to be positioned between the leading end and the distal end 108. In this way, allowing the paper product to be dispended from the apparatus.

Figure 1C:
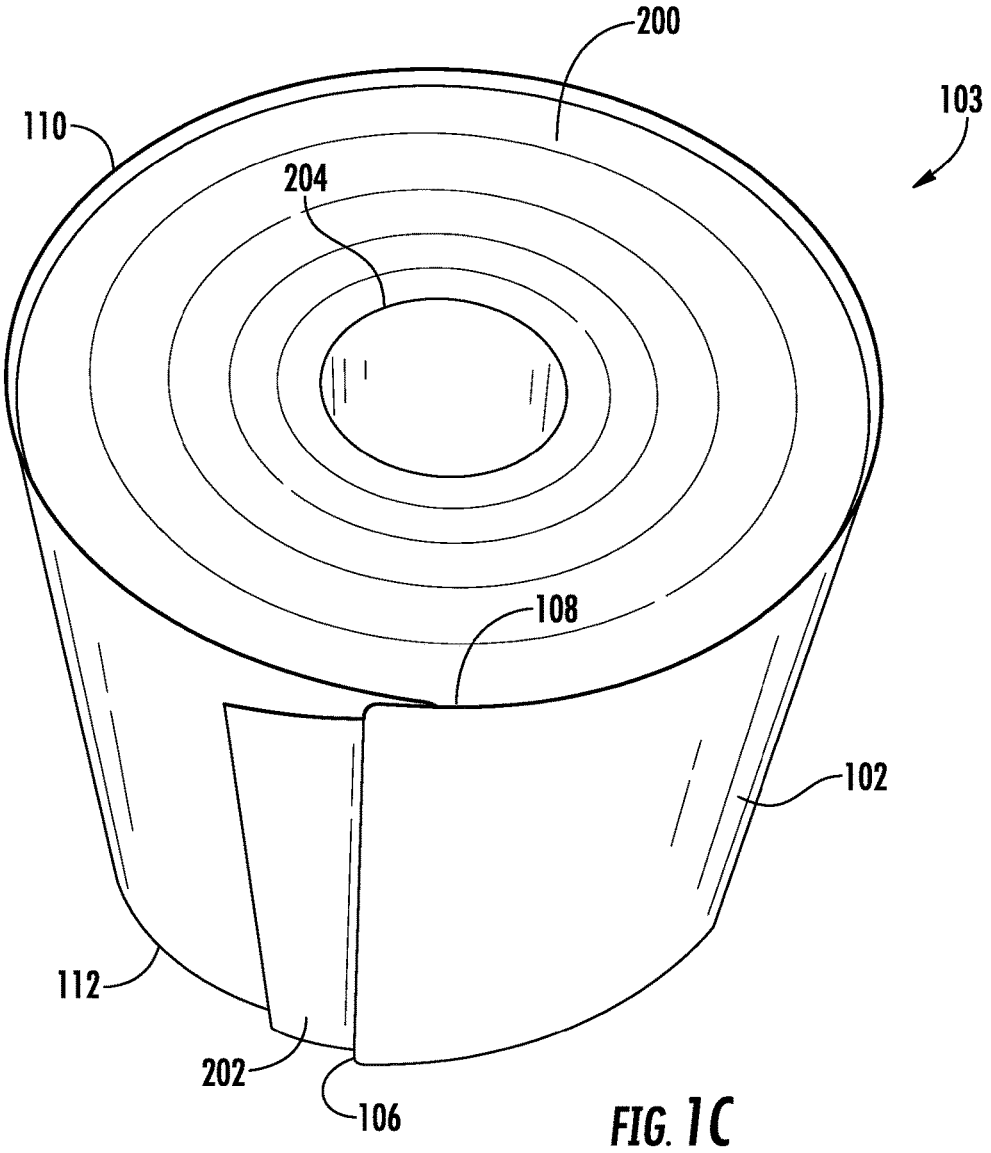
FIG. 1C is a top view of the apparatus, in accordance with one embodiment of the present invention.

FIG. 1C illustrates a top view of the apparatus 103. As illustrated in FIG. 1C the semi-flexible sheet 102 is formed so that it radially collapses to form a cylindrical shape around the paper product 200 with inner core 204. As such, the first side edge 110 and the second side edge 112 forming a shape around the paper product 200. When the semi-flexible sheet 102 is radially collapsed into a cylindrical shape, the leading end 106 overlays the distal end 108 and a portion of the semi-flexible sheet 102. The leading end 106, the distal end 108, and the portion of the semi-flexible sheet 102 form a gap or slit longitudinally along the edge, that allows a single sheet or a portion of a single sheet of the paper product 202 to be positioned between the leading end and the distal end 108. As illustrated in FIG. 1C the top of the paper product 200 and inner core 204 are exposed. As such, the apparatus is covering the sides of the paper product 200 in this embodiment.

An operator may manipulate the semi-flexible sheet 102 to place a roll of paper product 200 within the cylindrical shape of the semi-flexible sheet 102. In some embodiments, the semi-flexible sheet 102 may collapse onto the roll of sheeted material or paper product 200 such that an inner surface of the cylindrical shape formed by the semi-flexible sheet 102 exerts pressure on the roll of paper product 200. In some embodiments, the inner diameter of the cylindrical shape formed by the semi-flexible sheet 102 when fully radially collapsed is larger than the diameter of the inner core 204 of the roll of the paper product 200.

In some embodiments, the semi-flexible sheet 102 may be designed based on the roll of paper product 200. As such, the measurements of the semi-flexible sheet 102 may be based on the roll of paper products 200 the semi-flexible sheet 102 is being designed to protect. In other embodiments, the material used to make the semi-flexible sheet 102 may be selected based on the roll of paper products 200 the semi-flexible sheet 102 is being designed to protect.

As such, in some embodiments, the overall width and length of the semi-flexible sheet 102 may be determined based on the type of roll being protected by the apparatus. As an example. An apparatus protecting toilet paper may be smaller in width than an apparatus protecting paper towels, steel sheets, drawing paper, or the like In some embodiments, the width of the semi-flexible sheet 102 or the measurement of the leading end 106, may be equal to or greater than the height of the roll of paper product 200. As such, the semi-flexible sheet 102 may cover the entire outer surface area of the paper product. In this way, the measurement of the leading end 106 of the semi-flexible sheet 102 may be designed based on the height of the roll of paper product 200. In some embodiments, the measurement of the leading end 106 may be equal to the height of the roll of paper product 200. In other embodiments, the length of the leading end 106 may be greater than the height of the roll of paper product 200 to provide protection to the roll of paper product 200 and/or allow for additional features as will be explained herein. In some embodiments, the leading end 106 may be a length equal to the length of the distal end 108 of the semi-flexible sheet 102. In other embodiments, the distal end 108 of the semi-flexible sheet 102 may be shorter than the leading end 106.

In some embodiments, the length of the semi-flexible sheet 102 or the measurement of the first side edge 110 or second side edge 112 between the leading end 106 and the distal end 108 may also be determined based on the circumference of the roll of paper product. A larger roll of material or a thicker material may require a larger semi-flexible sheet 102. The semi-flexible sheet 102 is designed to cover the entire outside portion of paper product and overlap itself. As such, the length of the semi-flexible sheet 102 may be greater than the circumference of the roll of paper product at its capacity. As such the distance between the leading end 106 and distal end 108 may be designed to create a given diameter of the cylindrical shape around a roll of paper product 200 and include an overlap of material. For example, where a roll of paper product 200 has a given circumference, the distance between the leading end and the distal end 108 may be designed such that the circumference of the cylindrical shape formed by the semi-flexible sheet 102 when collapsed is greater than the circumference of the roll of paper product 200.

Furthermore, the radial collapsibility of the semi-flexible sheet 102 may be determined based on the roll of paper product 200. In this way, the semi-flexible sheet 102 may have a length long enough to overlap itself upon radial compression around a roll. Furthermore, the semi-flexible sheet 102 may, upon complete compression have an inner diameter that is slightly larger than the outer diameter of the core 204 of the roll of paper product 200. As such, as paper product 202 is removed from the roll of paper product 200 and the diameter of the cylindrical shape formed by the radial compression of the semi-flexible sheet 102 is reduce, the inner surface will apply at least an amount force or pressure on the roll of paper product 200, even after all of the paper product or sheet material has been dispensed.

In some embodiment, as disclosed above, while a variety of materials such as plastics, metals, fibers, polymers, or composites may be used to make the semi-flexible sheet 102, other factors associated with the material the apparatus is surrounding may play a role in determining the material used to create the semi-flexible sheet 102. Such factors might include protection requirements for the paper product 202, a rigidity of the semi-flexible sheet 102 required, an applied pressure requirement for the roll of paper product 200, whether an attachment mechanism is included, whether a gripping edge is included, and/or the like. In some embodiment.

In some embodiments, one factor to consider in selecting the material used for the semi-flexible sheet 102 is the type of product that the semi-flexible sheet 102 will protect. As such, the semi-flexible sheet 102 may be required to comprise water protection properties, dirt protection properties, be constructed to protect from excess force, temperature protection, element protection, or the like. In some embodiments, materials may be selected based on their ability to protect the paper product 202. For example, some materials must be protected from water damage. Materials such as plastics have a high ability to repel water. Other protections may include protection from dirt or other staining elements, protection from radiation such as ultraviolet (UV) light, protection from abrasion or other mechanical wear, and protection from punctures or cutting.

In some embodiments, one factor to consider in selecting the material may be the rigidity of the semi-flexible sheet 102 required. The rigidity of the material may be based on the modulus of elasticity of the material, the sheet strength of the material, and the like. These factors will be discussed to influence the design of the semi-flexible sheet 102 and the material from which the semi-flexible sheet 102 is manufactured.

In some embodiments, one factor to consider in selecting the material may be the applied pressure requirement for the roll of paper product 200. In this way, when the paper product 202 is rolled up into the roll of paper product 200, the material may apply a force causing the paper product 202 to maintain its shape and prevent it from unwinding. This force is applied radially across the entire roll evenly based on the spring like nature of the semi-flexible sheet 102. A greater presser may be required to prevent rolls of steel or other products from unwinding relative to disposable paper rolls.

Furthermore, the semi-flexible sheet 102 may include a pressure requirement that allows material from the roll to be removed through the slit or gap created. In some embodiments, the applied pressure may be such that there is a resistance between the gap, but still allows paper product 202 to be removed through the gap.

Figure 2A:
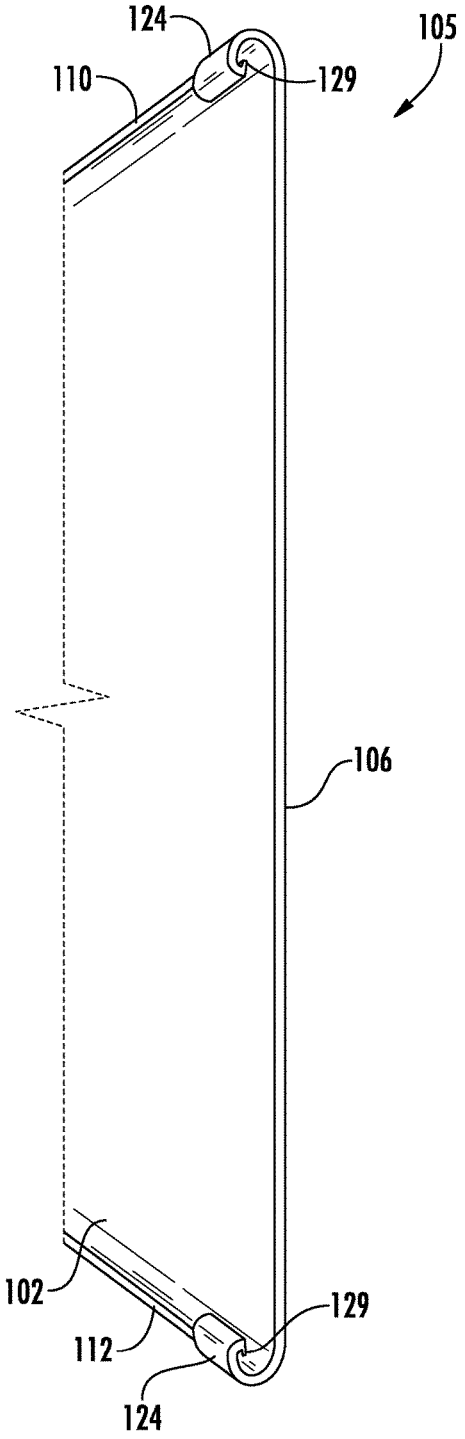
FIG. 2A is a front view of the apparatus with clips, in accordance with one embodiment of the present invention.

FIG. 2A illustrates a front view of the apparatus with clips 105, in accordance with one embodiment of the present invention. As illustrated in FIG. 2A, a semi-flexible sheet 102 is illustrated comprising a leading end 106, a first side edge 110, and a second side edge 112. The semi-flexible sheet 102 further comprises attachment mechanisms 124. The first attachment mechanism 124 is connected to the first side edge 110 of the semi-flexible sheet 102 and located proximate to the leading end 106. The second attachment mechanism 124 is connected to the second side edge 112 and located proximate to the leading end 106. In some embodiments, the attachments mechanisms 124 may be J shaped clips that form a gap between the clips and a surface of the semi-flexible sheet 102. A portion of the semi-flexible sheet 102 may be positioned into the gap between the clip and semi-flexible sheet 102 such that the clip applies pressure to a portion of the semi-flexible sheet 102 to inhibit movement of the semi-flexible sheet 102 but allow repositioning of the semi-flexible-sheet with sufficient force. Furthermore, allowing a user to remove one or more sheets of the paper product from the apparatus without the apparatus loosing tension around the paper product. The attachment mechanism may further comprises a hook 129.

Figure 2B:
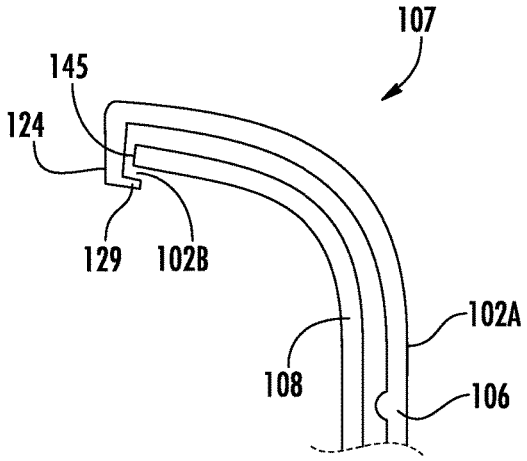
FIG. 2B is an expanded end view of the clips of the apparatus, in accordance with one embodiment of the present invention.

FIG. 2B is an expanded end view of the clips of the apparatus 107, in accordance with one embodiment of the present invention. FIG. 2B illustrates the attachment mechanism 124 attaching to a portion of the semi-flexible sheet 102B. As such, the leading end 106 with the attachment mechanism 124 and a portion of the semi-flexible sheet 102A overlaps the distal end 108 and a portion of the semi-flexible sheet 102B located proximate to the distal end 108. In this way, the attachment mechanism 124 forms a hook 129 around the semi-flexible sheet 102B, securing the semi-flexible sheet 102B in a radially collapsed position about itself. Furthermore, a gap 145 is formed between the clipped semi-flexible sheet 102B and the semi-flexible sheet 102A such that paper product may be dispensed through the gap 145 created.

Figure 2C:
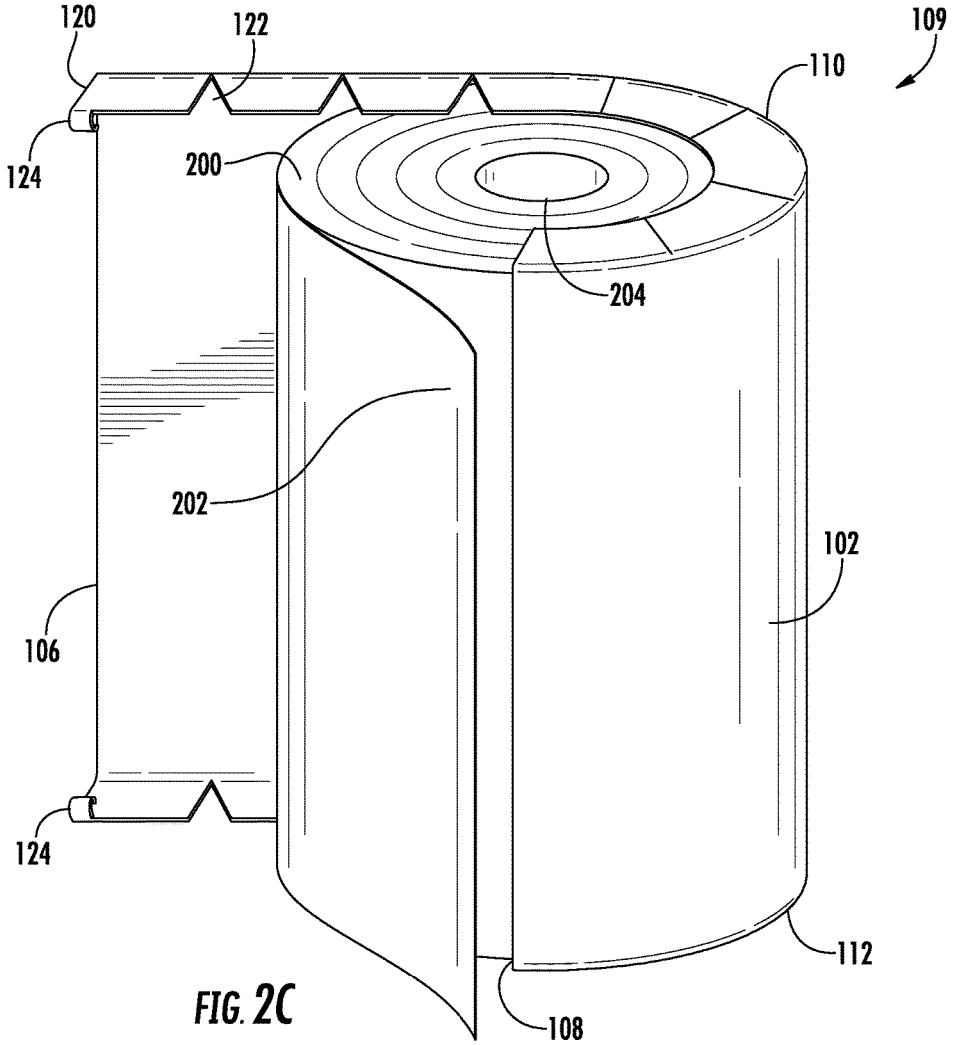
FIG. 2C is a perspective view of an embodiment of the apparatus, in accordance with one embodiment of the present invention.

FIG. 2C illustrates a perspective view of an embodiment of the apparatus 109, in accordance with one embodiment of the present invention. As illustrated in FIG. 2C a semi-flexible sheet 102 comprises a leading end 106 a distal end 108, a first side edge 110, and a second side edge 112. The semi-flexible sheet 102 is manufactured such that it is capable of being radially collapsible into a cylindrical shape or other shape over a roll of paper product 200. As illustrated, the roll of paper product 200 includes an inner core 204 and a single sheet coming from the roll of paper product 202.

In some embodiments, the semi-flexible sheet 102 includes one or more end covers 120 and an attachment mechanism 124. The semi-flexible sheet 102 may include multiple end covers 120, where the end covers 120 are attached to and extend perpendicularly from the first side edge 110 and the second side edge 112. The end covers 120 are located such that they cover at least a portion of the roll of paper product 220. The end covers 120 comprise angled spaces 122 between the end covers 120 that create notches and allow semi-flexible sheet 102 to be collapsed into a cylindrical shape without causing the end covers 120 to bind. When the semi-flexible sheet 102 is radially collapsed into a spherical shape, the notches 122 of the end cover 120 are reduced in size until the inside edges of the angled spaces 122 are in contact with one another either end-to-end or overlapping. Thus, the angled spaces 122 provide a completely closed area when the semi-flexible sheet 102 is radially collapsed into the cylindrical shape around the roll of paper products 200.

In some embodiments, the semi-flexible sheet 102 comprises one or more attachment mechanisms 124. These attachment mechanisms 124 create a clip or hinge configured in a J shape. The attachment mechanism 124, in this embodiment, extends from the end cover 120 along the leading edge and create the J shaped clip. The attachment mechanisms 124 are utilized to attach to a portion of the semi-flexible sheet 102 and/or one or more end covers 120 at a point along the semi-flexible sheet 102 away from the leading end 106. As such, when the semi-flexible sheet 102 is radially collapsed into the cylindrical object, the attachment mechanism 124 may be releasably attached to another portion of the semi-flexible sheet or the end cover 120. As the roll of paper product 200 is dispensed, the attachment mechanisms 124 when releasably attached to the one or more end covers 122, move along the one or more end covers 120 closer in proximity to the leading edge 106. When the roll of paper products 200 is at maximum capacity, the attachment mechanisms 124 are releasably attached to one or more end covers 120 proximate to the distal end 108.

Figure 2D:
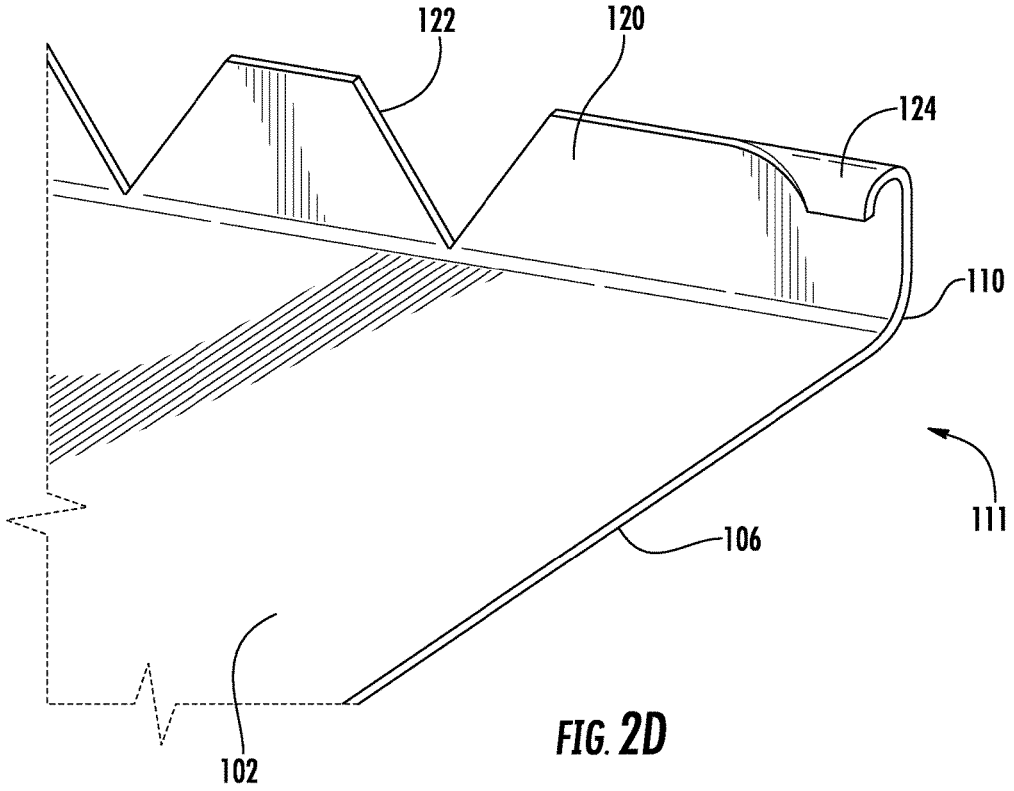
FIG. 2D is an expanded view of an embodiment of the apparatus, in accordance with one embodiment of the present invention.

FIG. 2D is an expended view of an embodiment of the apparatus 111, in accordance with one embodiment of the present invention. As illustrated in FIG. 2D the flexible sheet 102 comprises a leading end 106 and a first side edge 110. The semi-flexible sheet 102 further comprises end cover 120 with angled spaces 122 between each end cover 120. Referring the FIG. 2D, the semi-flexible sheet 102 may have one or more attachment mechanisms 124, where each attachment mechanism is attached to at least one of the end covers 120.

Figure 2E:
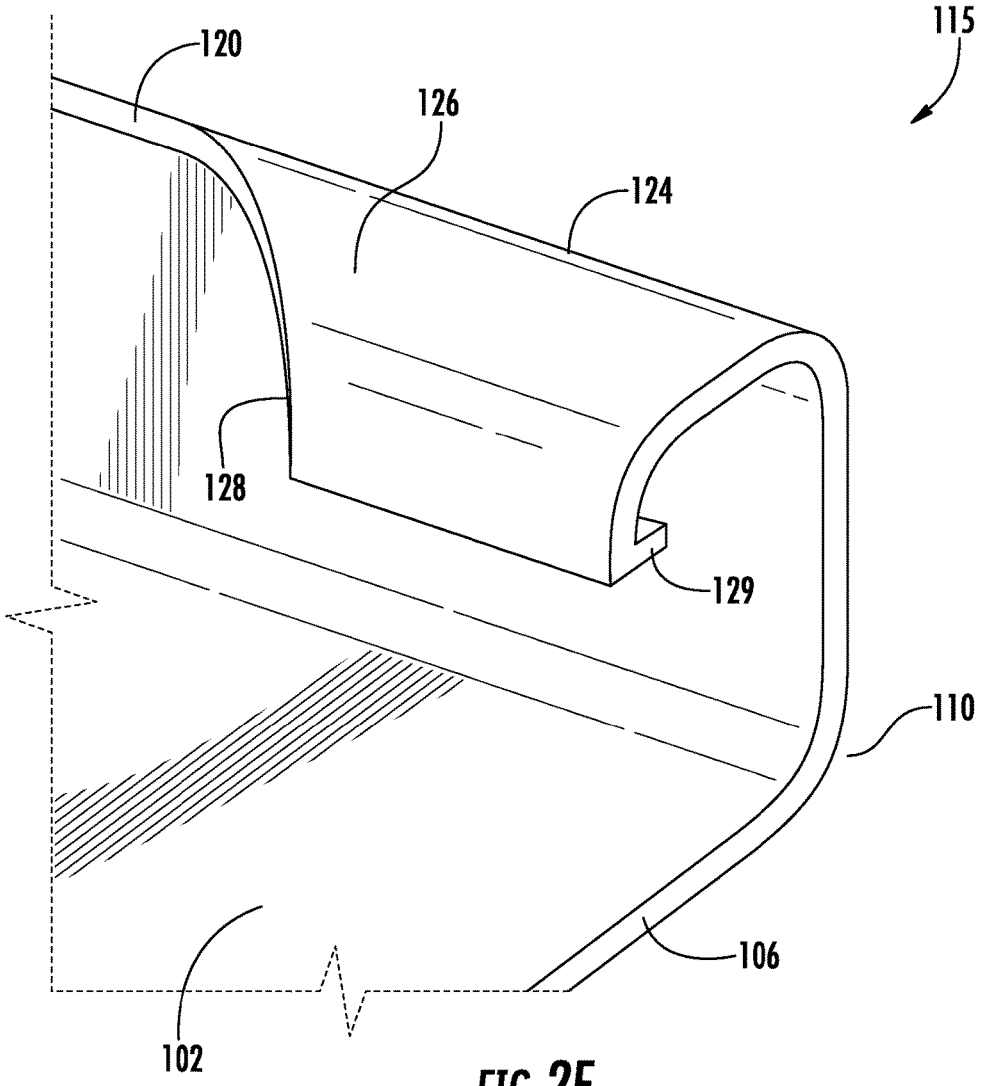
FIG. 2E is an expanded view of the attachment mechanism of the apparatus, in accordance with one embodiment of the present invention.

FIG. 2E illustrates an expended view of the attachment mechanism of the apparatus 115, in accordance with one embodiment of the present invention. The attachment mechanism 124 is attached and perpendicular to the end covers 120. While only one attachment mechanism 124 is illustrated in FIG. 2E, one of ordinary skill in the art will appreciate that multiple attachment mechanisms 124 may be present. The attachment mechanism 124 is attached to the end cover 120 on the leading edge 106 of the semi-flexible sheet 102. The expanded view illustrated in FIG. 2E illustrates the attachment mechanism 124 on the first side edge 110 of the semi-flexible sheet 102. As illustrated in FIG. 2E, the attachment mechanism 124 forms a J shape clip. The attachment mechanism 124 comprises a curved top surface 126 that connects to and is located perpendicular to the end cover 120 and a flat front surface 128 which is connected to and perpendicular to the first edge 126 of the attachment mechanism 124. Further, attachment mechanism further comprises a hook 129 that is connects to and is located perpendicular to the flat front surface 128.

In some embodiments, the attachment mechanism 124 may be a clip that is connected to the first side edge 110 of the semi-flexible sheet 102 such that a portion of the clip is designed to apply pressure to a portion of the semi-flexible sheet 102 against another portion of the semi-flexible sheet 102. In various embodiments, the clip may be made of the same material of the semi-flexible sheet 102 and be formed from the first side edge 110 of the semi-flexible sheet 102.

The clip may include a top surface 126 and a front surface 128. The top surface may connect with the first side edge 110 (as illustrated in FIG. 2A-2B) or the end cover 120 (FIG. 2C-2E) of the semi-flexible sheet 102. The top surface 126 may be located in a face-to-face relation with the semi-flexible sheet 102 such that a gap is formed between the front surface and the semi-flexible sheet 102. In some embodiments, the gap is sized depending on the thickness of the semi-flexible sheet 102 and the paper product held therein. In other embodiments, the gap is smaller than the thickness of the semi-flexible sheet 102. The attachment mechanism 124 functions as a J shaped clip that is operated by placing a portion of the semi-flexible sheet 102 between attachment mechanism 124 and the semi-flexible sheet 102 when the semi-flexible sheet 102 is radially collapsed. Thus the clip retains the semi-flexible sheet 102 in a cylindrical shape of a given dimension. The portion of the semi-flexible sheet 102 positioned in the gap of the clip may be operatively removed at any time, thus allowing a user to insert a roll of paper product into the apparatus.

In this way, after inserting the roll of paper product, the user may place the semi-flexible sheet 102 in to the clip and thus retain the semi-flexible sheet 102 in the collapsed radial position tight around the roll of paper product. Furthermore, the gap created between the two portions of the semi-flexible sheet between the attachment mechanism allows a single sheet of the paper product to be dispensed through the gap. As the paper product is dispensed and the outer diameter of the roll of paper product is reduced, the clip may be positioned such that an inner diameter of the semi-flexible sheet 102 is equal to the outer diameter of the roll of paper product.

In other embodiments, the attachment mechanism may include multiple attachment regions in order to operate. Examples of such a mechanism might include, but is not limited to, zippers, magnets, adhesive, buttons, clasps, snaps, straps, hock, eyelets, Velcro®, and the like. Where the attachment mechanism requires multiple attachment regions, the attachment mechanism may comprise a first attachment region that attaches to at least a second attachment region. The first attachment region may be located along an edge or end of the semi-flexible sheet. The location of the second attachment mechanism may be located at one or more positions along the first or second edge of the semi-flexible sheet. For example, where the attachment mechanism is a snap, the snap may consist of at least an insertion piece located at a corner next to the leading end, multiple receiving pieces. The insertion piece may be located where the leading end 106 and the first side edge 110 form a corner. The multiple receiving pieces may be located along the first side edge 110 such that the insertion piece may be connected with any one of the multiple receiving pieces. By connecting the insertion piece with a given receiving piece, the diameter of the cylindrical shape may be adjusted. While attachment mechanisms are generally described above as being on the first side edge 110, one of ordinary sill in the art will appreciate that the attachment mechanisms may also be the same or similar along the second side edge 112.

Figure 2F:
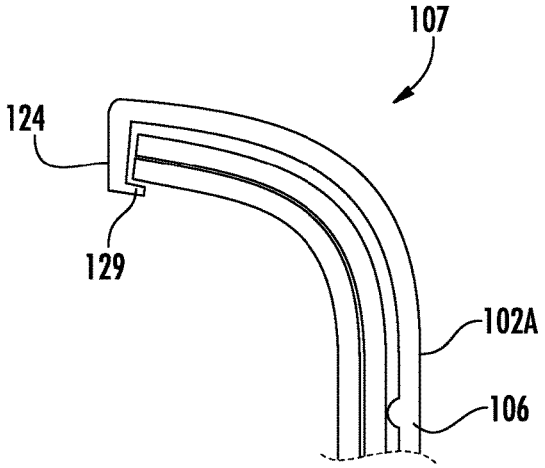
FIG. 2F is an expanded view of the attachment mechanism of the apparatus, in accordance with one embodiments of the present invention.

FIG. 2F illustrates a sectional view of an attachment mechanism 107, where the attachment, similar to the attachment mechanism 107 featured in FIG. 2B. FIG. 2F illustrates the attachment mechanism 124 attaching to a multiple portions of the semi-flexible sheet 102B. As the roll of sheet material 200 is dispensed, the semi-flexible sheet 102 radially contracts. As the radius of the semi-flexible sheet 102 is reduced, the leading end 106 travels tangential to the curvature of the semi-flexible sheet 102. When enough of the sheet material 200 has been dispensed, the leading end 106 travels passed the distal end 108 for a second time and the attachment mechanism 124 is configured to hold multiple portions of the either the first side end 110 or the second side end 112.

Figure 3:
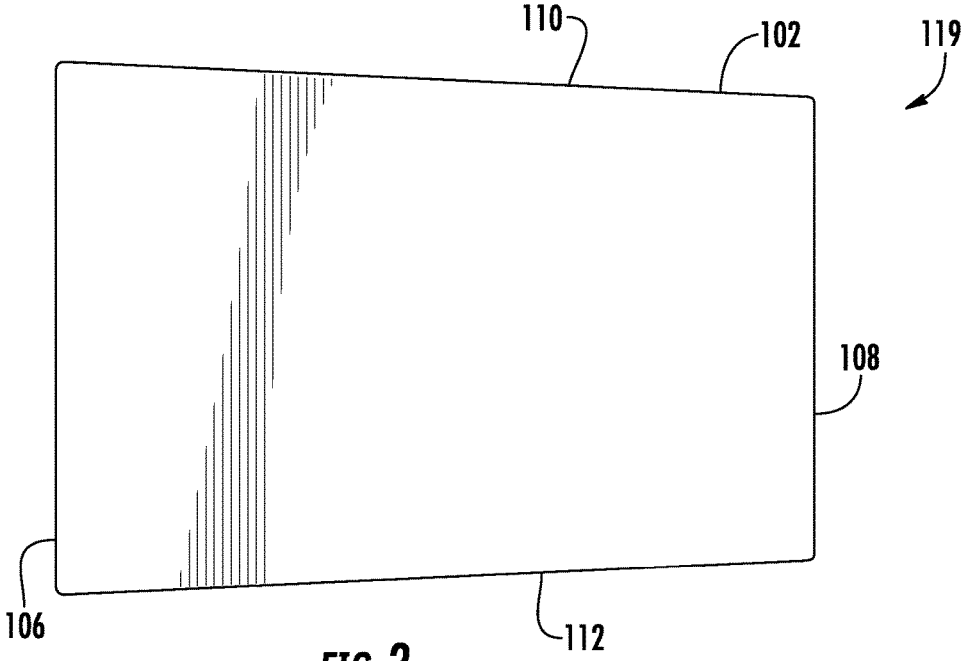
FIG. 3 is a flattened front view of an embodiment of the apparatus, in accordance with one embodiment of the present invention.

FIG. 3 illustrates a flattened front view of an embodiment of the apparatus 119, in accordance with one embodiment of the present invention. As illustrated in FIG. 3, the taper travels along the semi-flexible sheet 102 from the leading end 106 to the distal end 108. As illustrated in FIG. 3, the taper may begin at any point located near or at the leading end 106 and travels along the first side edge 110 and the second side edge 112, thus forming a consistent taper along the first side edge 110 and the second side edge 112. The taper may be symmetric to a center line of the semi-flexible sheet 102 formed by the leading edge 106 and the distal edge 108. In other embodiments, the taper is located on either the first side edge 110 or the second side edge 112 but not both. In some embodiments, the taper may be small and make the leading end 106 only slightly longer than the distal end 108. In some embodiments, the taper may be larger and make the leading end 106 significantly longer than the distal end 108. The taper is then designed to fit into the paper product, this allowing for easy alignment of the apparatus onto and over the roll of paper product. Furthermore, this taper allows a sheet of the paper product to be dispensed through the gap created by the apparatus, such that a single sheet may be dispensed at a time.

Figure 4A:
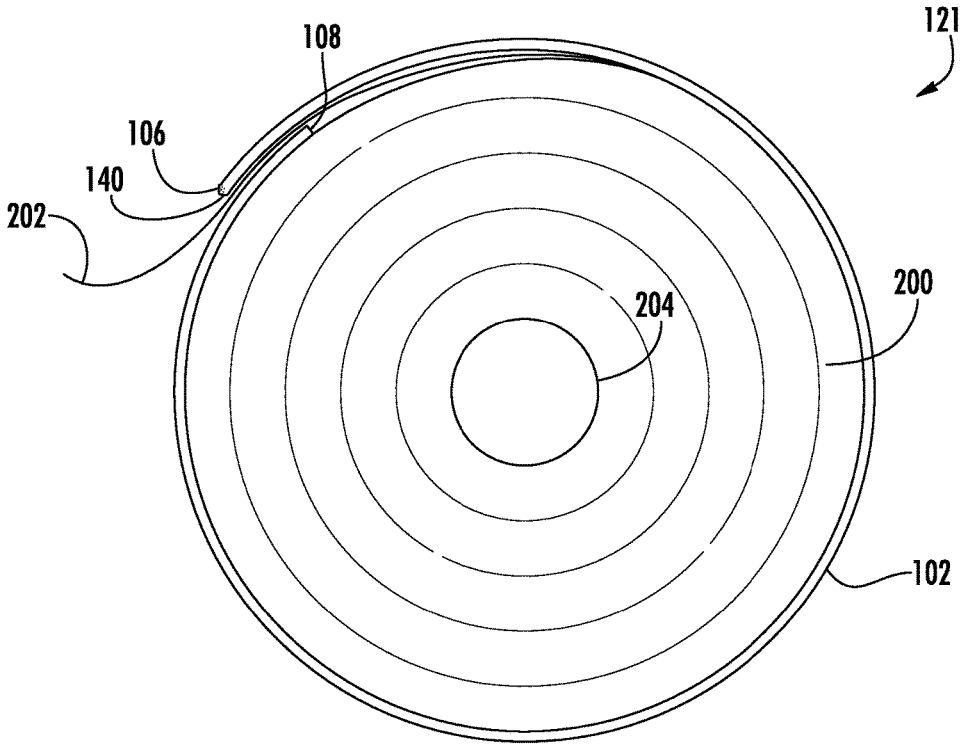
FIG. 4A is an end view of an embodiment of the apparatus, in accordance with one embodiment of the present invention.
Figure 4B:
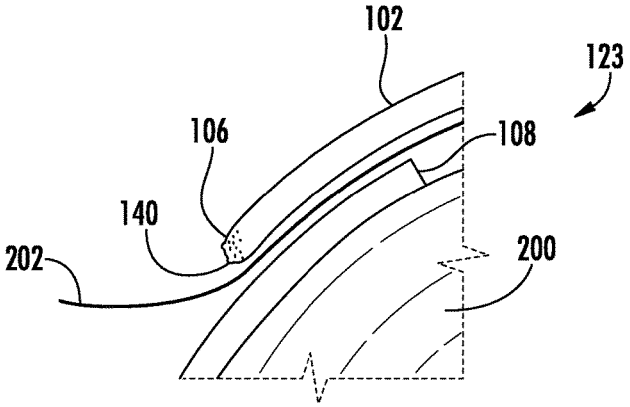
FIG. 4B is an expanded cross sectional view of an embodiment of the apparatus comprising a gripping surface, in accordance with one embodiment of the present invention.
Figure 4C:
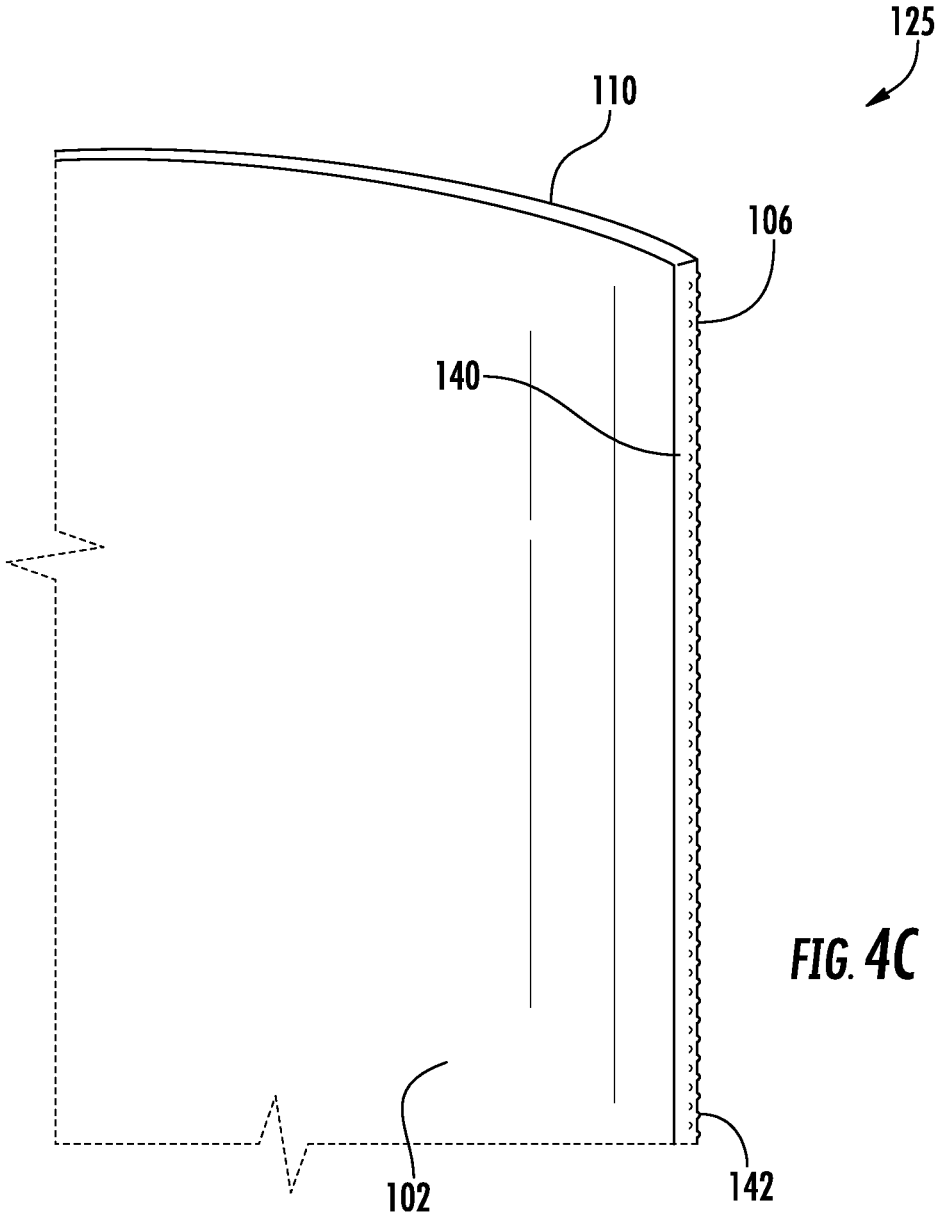
FIG. 4C is an expanded perspective view of the gripping surface of the apparatus, in accordance with one embodiment of the present invention.

FIGS. 4A-4C illustrate a semi-flexible sheet 102 that includes a gripping surface 140 located along at least a portion of the leading end 106. The gripping surface 140 is positioned perpendicularly to the semi-flexible sheet 102. The gripping surface 140 may be configured to allow travel of a sheet of paper product 202 pass the gripping surface 140 when pulled tangentially to the leading end 106 of the apparatus. The gripping surface 140 may be further configured to grip the sheet of paper product 202 when the sheet of paper product 202 is pulled perpendicularly to the leading end 106 of the apparatus. In some embodiments, the gripping surface 140 may be made of the same material as the semi-flexible sheet 102. In some embodiments, the gripping surface 140 may be made from a different material than the semi-flexible sheet 102. In some embodiments, the gripping surface 140 may be strong enough or comprise the necessary serrations to cut the material on the roll.

FIG. 4A illustrates an end view of an embodiment of the apparatus 121, in accordance with one embodiment of the present invention. As illustrated the roll of paper product 200 including core 204 is positioned within the apparatus and the semi-flexible sheet 102. A sheet of the paper product 202 extends through the created gap in the apparatus between the leading end 106 and the distal end 108.

FIG. 4B illustrates an expanded cross sectional view of an embodiment of the apparatus comprising a gripping surface 123, in accordance with one embodiment of the present invention. As illustrated, the sheet of paper product 202 may slide between the gap created in the semi-flexible sheet 102 between the leading end 106 and the distal end 108. The sheet of paper product 202 may be pulled past the gripping surface 140 when pulled tangentially to the leading end 106 of the apparatus. The gripping surface 140 may be further configured to catch and grip the sheet of paper product 202 when the sheet of paper product 202 is pulled perpendicularly to the leading end 106 of the apparatus.

FIG. 4C illustrates an expanded perspective view of the gripping surface of the apparatus 125, in accordance with one embodiment of the present invention. As illustrated in FIG. 4C, the semi-flexible sheet 102 comprises a gripping surface 140 on the leading end 106 of the semi-flexible sheet 102. The gripping edge of the gripping surface 140 may be dimpled 142 and be located along the entire length of the leading end 106 of the semi-flexible sheet 102 to aid in gripping the sheet material 202.

In other embodiments, the gripping surface 140 may be serrated for cutting the paper product 202 when the sheet of paper product 202 is pulled perpendicularly to the leading end 106 of the apparatus. The size of the serration may be determined based on properties of the paper product 202. For example, determining the size of the serration may be based on tear resistance of the paper product 202. Other material properties might include tensile strength, modulus of elasticity, and elongation of the paper product 202. In addition to parameters of the paper product 202, other factors may influence the size and design of the serration 202. For example, human safety may be a contributing factor.

Figure 5:
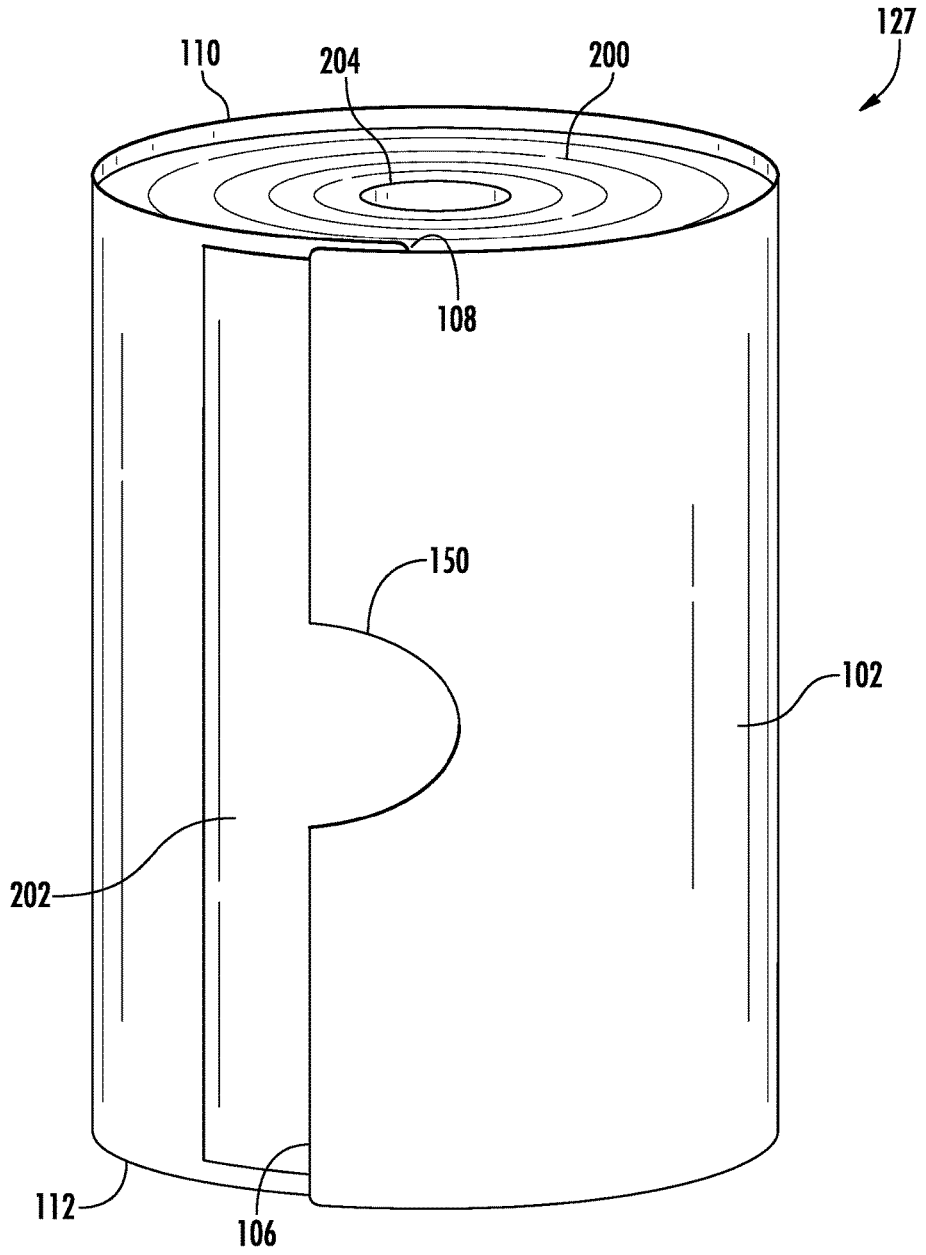
FIG. 5 is a perspective view of an embodiment of the apparatus, in accordance with one embodiment of the present invention.

FIG. 5 illustrates a perspective view of an embodiment of the apparatus 127, in accordance with one embodiment of the present invention. The apparatus includes a semi-flexible sheet 102 with a leading end 106 a distal end 108, a first side edge 110, and a second side edge 112. The semi-flexible sheet 102 is manufactured such that it is capable of being radially collapsible into a cylindrical shape or other shape over a roll of paper product 200. As illustrated, the roll of paper product 200 includes an inner core 204. In this way, the semi-flexible sheet 102 provides a spring like force upon radially collapsing that provides an inward tension onto the roll of paper product 200. Thus, completely surrounding the sides of the paper product and providing protection to the paper products. When the semi-flexible sheet 102 is radially collapsed into a cylindrical shape, the leading end 106 overlays the distal end 108 and a portion of the semi-flexible sheet 102. The leading end 106 in the embodiment illustrated in FIG. 5 illustrates a notch 150 located on the leading end 106. The notch 150 may located at any point along the leading end 106. In some embodiments, the notch 150 is centrally located along the leading end 106, as illustrated in FIG. 5. In other embodiments, the notch 150 may be located such that it interfaces with either the first side edge 110 or the second side edge 112.

The notch may be designed to allow for presentation of a sheet of paper product 202. The notch enables a user to grab a portion of the sheet of paper product 202. Where the leading end 106 of the semi-flexible sheet 102 includes a gripping surface 140, the gripping surface 140 may cut the paper product 202 such that a portion of the paper product 202 does not extend past the leading end 106 of the semi-flexible sheet 102. Without the location of the notch 150 on the leading end 106 of the semi-flexible sheet 102, the entire portion of the sheet of paper product 202 may be covered by the semi-flexible sheet 102. With the inclusion of the notch 150 along the leading end 106 of the semi-flexible sheet 102, a user may be able to grab the exposed portion of the paper product 202 without having to manipulate the semi-flexible sheet to expose a sheet of paper product 202.

Figure 6A:
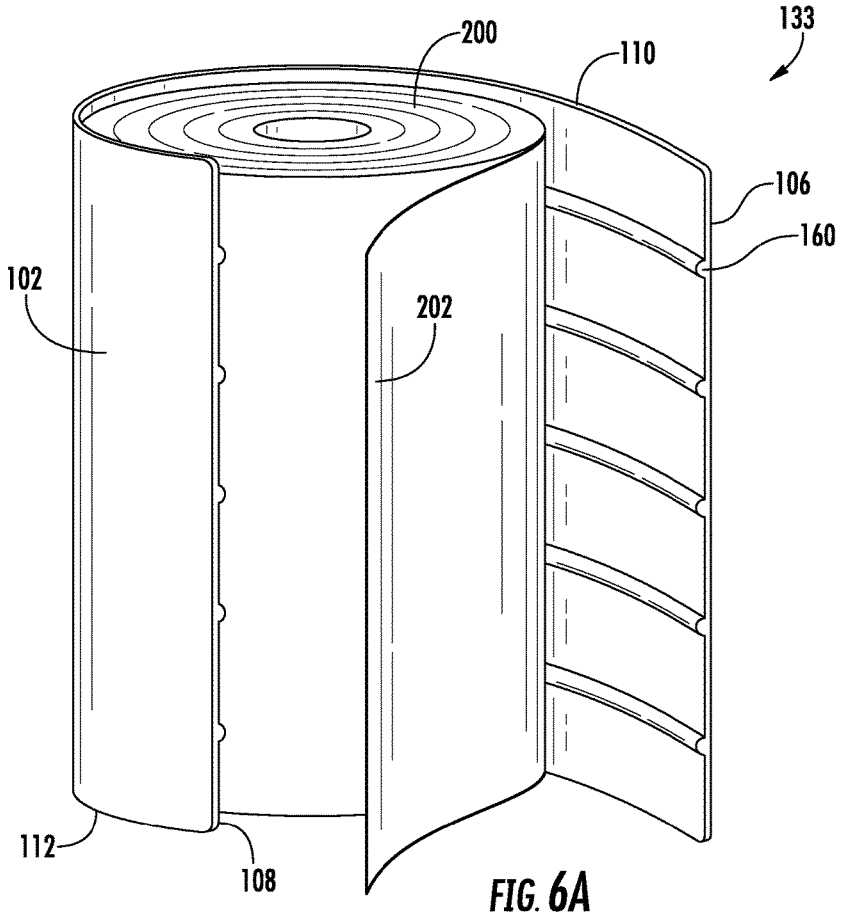
FIG. 6A is perspective view of an embodiment of the apparatus, in accordance with one embodiment of the present invention.

FIG. 6A illustrates a perspective view of an embodiment of the apparatus 133, in accordance with one embodiment of the present invention. FIG. 6A illustrates a semi-flexible sheet 102 in accordance with various embodiments of the invention which includes ribs 160. The ribs are located along the semi-flexible sheet 102 starting at the leading end 106 and ending at the distal end 108. The ribs 160 may be located parallel to the first side edge 110, the second side edge 112, and each other. In some embodiments, the ribs 160 are located on one side of the semi-flexible sheet 102 that faces the roll of paper product 200. In some embodiments, the ribs 160 may be located as to prevent axial movement of the roll of paper product 200 when the semi-flexible sheet 102 is radially collapsed forming the cylindrical shape but allow a sheet of paper product 202 to be dispensed when force is applied on the paper product 202. The ribs 160 may also assist in radially collapsing the semi-flexible sheet 102.

Figure 6B:
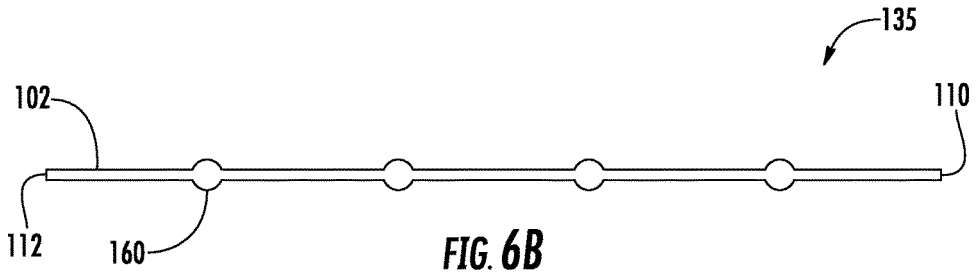
FIG. 6B is a cross sectional view of an embodiment of the apparatus comprising ribs, in accordance with one embodiment of the present invention.

FIG. 6B illustrates a cross sectional view of an embodiment of the apparatus comprising ribs 135, in accordance with one embodiment of the present invention. As illustrated, the ribs 160 may be parallel to the first side edge 110 and the second side edge 112. In some embodiments, the ribs 160 may not be parallel to the first side edge 110 and the second side edge 112. The ribs 160 may extend on one or both sides of the semi-flexible sheet 102. In the embodiment illustrated in FIG. 6B the ribs 160 extend into both a top and bottom of the semi-flexible sheet 102.

Figure 7A:
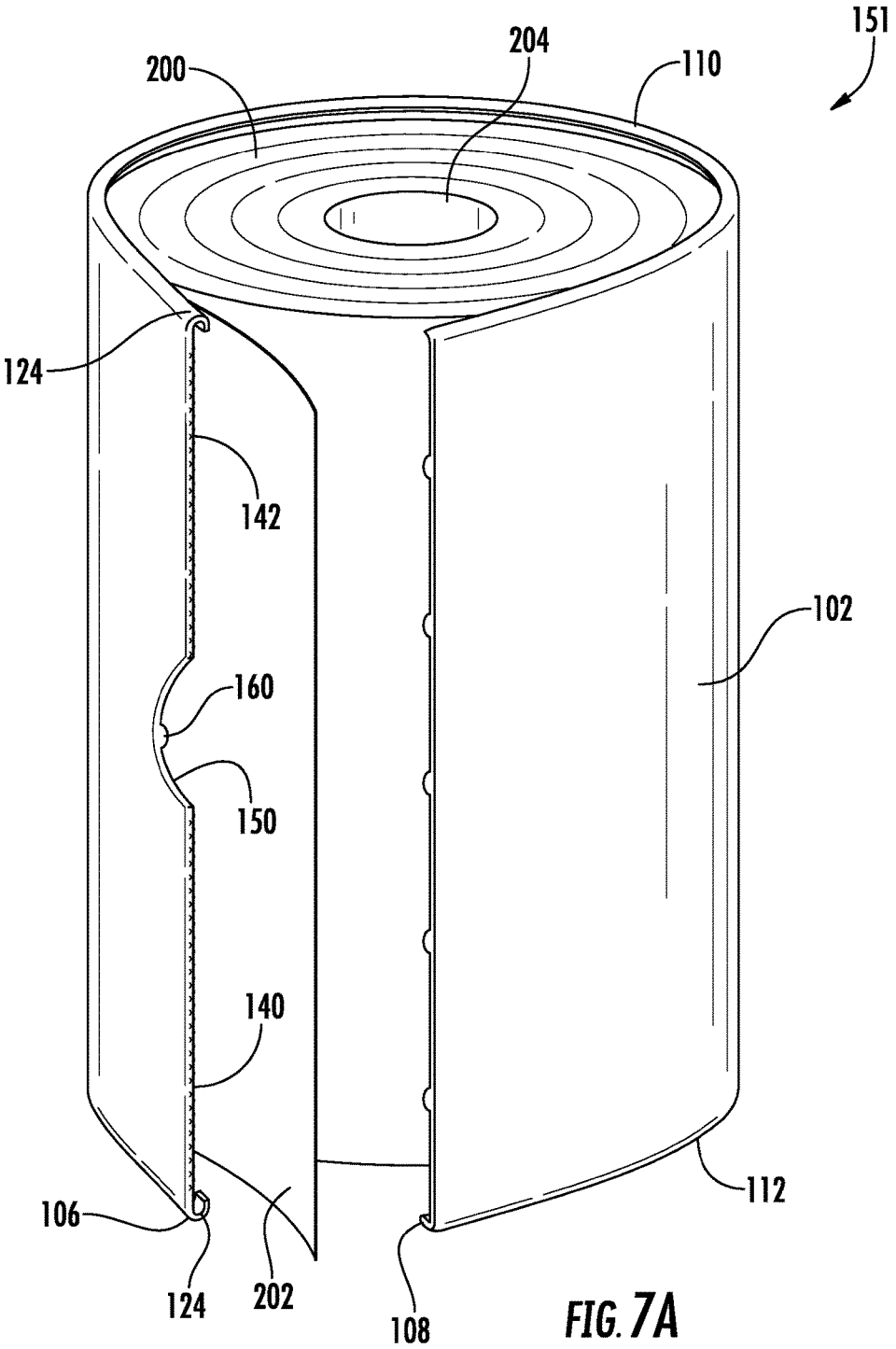
FIG. 7A is a perspective view of an embodiment of the apparatus, in accordance with one embodiment of the present invention.

FIG. 7A is a perspective view of an embodiment of the apparatus 151, in accordance with one embodiment of the present invention. As illustrated, a semi-flexible sheet 102 is included. The semi-flexible sheet 102 comprises a leading end 106, a distal end 108, a first side edge 110, and a second side edge 112. The semi-flexible sheet 102 is radially collapsible into a cylindrical shape over a roll of paper product 200. When the semi-flexible sheet 102 is radially collapsed into a cylindrical shape, the leading end 106 overlays the distal end 108 and a portion of the semi-flexible sheet 102. The leading end 106, the distal end 108, and the portion of the semi-flexible sheet 102 form a gap that allows a portion of the paper product 202 to be positioned between the leading end and the distal end 108. The length of the leading end 106 is greater than the length of the distal end 108 of the semi-flexible sheet 102, thus resulting in a taper of at least a portion of the first side edge 110 and the second side edge 112 of the semi-flexible sheet 102.

The semi-flexible sheet 102 comprises a gripping surface 140 with a serrated edge 142 located at least partially along the leading end 106. The gripping surface 140 allows dispensing of the roll of paper product 200 when force is applied to the paper product 202 tangentially to the roll of paper product 202. The gripping surface 140 further cuts the paper product 202 when the paper product 202 is pulled perpendicularly to the gripping surface. The semi-flexible sheet 102 further comprises a notch 160 located centrally along the leading end 106. The notch 160 reveals a portion of the paper product 202 to aid in grabbing the paper product 202. The semi-flexible sheet further comprises multiple attachment mechanisms 124. One of the attachment mechanisms 124 is connected to the first side edge 110 and located proximately to the leading end 106 of the semi-flexible sheet 102. The other attachment mechanism 124 is connected to the second side edge 112, and is located proximately to the leading end 106 of the semi-flexible sheet 102. The attachment mechanisms 124 form a gap with a surface of the semi-flexible sheet 102 which retain another portion of the semi-flexible sheet 102, thus causing the semi-flexible sheet 102 to remain in the cylindrical shape. The attachment mechanisms 124 further allow the semi-flexible sheet 102 to be adjusted, thus changing a diameter of the cylindrical shape of the semi-flexible sheet 102.

The semi-flexible sheet 102 further comprises ribs 160 located on at least one surface of the semi-flexible sheet, where the ribs 160 aid the semi-flexible 102 sheet in radially collapsing into the cylindrical shape. Additionally, the ribs 160 inhibit axial movement of the roll of paper product 200, while allowing the roll of paper product 200 to be dispensed.

Figure 7B:
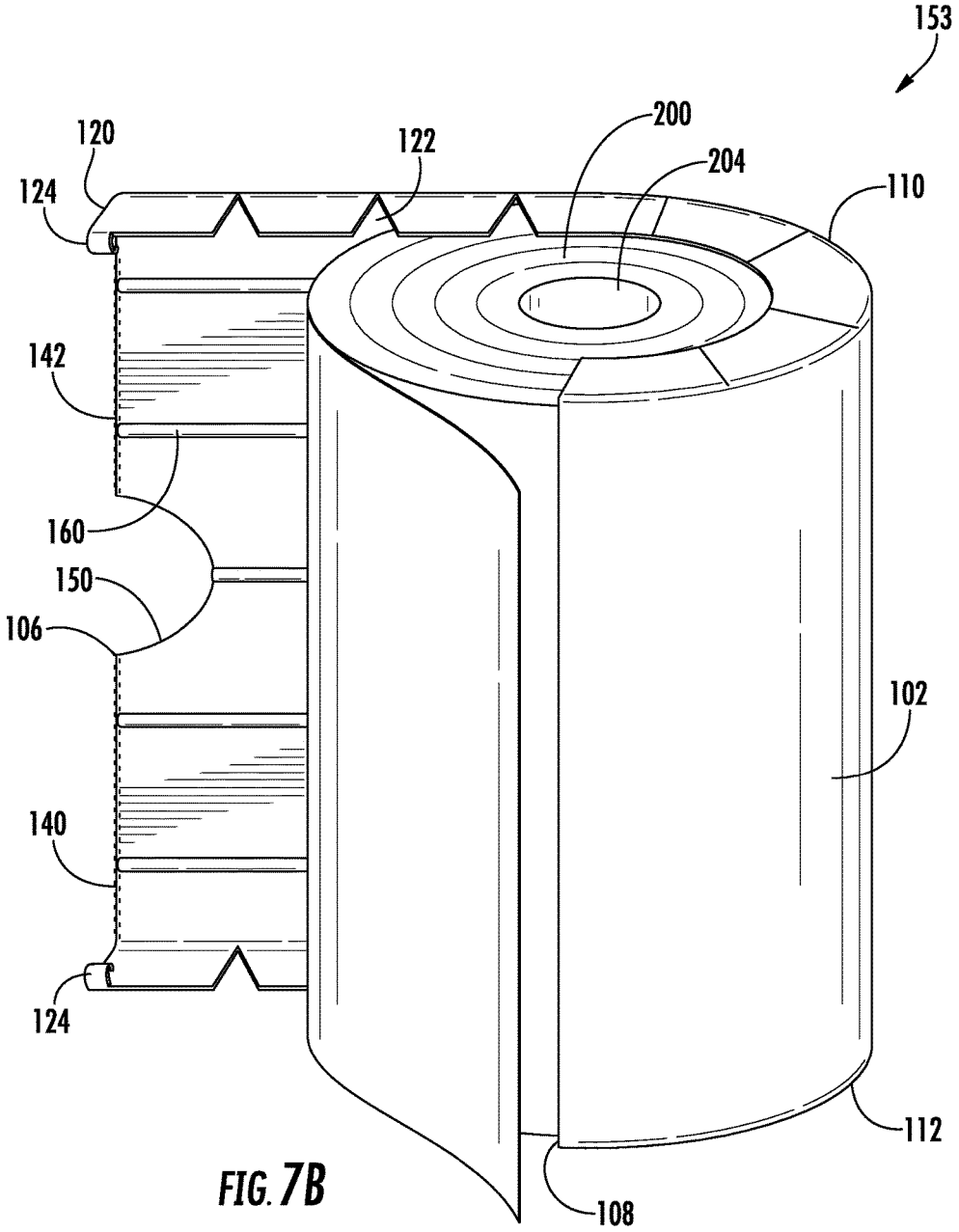
FIG. 7B is a perspective view of an embodiment of the apparatus, in accordance with one embodiment of the present invention.

FIG. 7B illustrates a perspective view of an embodiment of the apparatus 153, in accordance with one embodiment of the present invention. The semi-flexible sheet 102 illustrated comprises a leading end 106, a distal end 108, a first side edge 110, and a second side edge 112. The semi-flexible sheet 102 is radially collapsible into a cylindrical shape over a roll of paper product 200 comprising a core 204.

The semi-flexible sheet 102 comprises a gripping surface 140 with a serrated edge 142 located at least partially along the leading end 106. The semi-flexible sheet 102 further comprises a notch 160 located centrally along the leading end 106. The notch 160 reveals a portion of the paper product 202 to aid in grabbing the paper product 202.

The semi-flexible sheet 102 further comprises multiple end covers 120. One of the end covers 120 is connected perpendicularly to first side edge 110 of the semi-flexible sheet 102. The other end cover 120 is connected perpendicularly to the second side edge 112 of the semi-flexible sheet 102. The end covers 120 are positioned such that when the semi-flexible sheet 102, when radially collapsed over the roll of paper product 200 cover at least a portion of the roll of paper product 200. Thus providing protection to the ends of the paper product 200.

The end covers 120 comprise multiple attachment mechanisms 124. The attachment mechanisms 124 are connected to the end covers 120 and form a gap with a surface of the end covers 120. The gaps of the end covers 120 accept another portion of the end covers 120 and retain the semi-flexible sheet 102 in a cylindrical shape. The attachment mechanisms 124 further allow the semi-flexible sheet 102 to be adjusted, thus changing a diameter of the cylindrical shape of the semi-flexible sheet 102. The end covers 120 further comprise angled apertures 122 that allow the semi-flexible sheet 102 to be collapsed into a cylindrical shape without causing the end covers 120 to bind. When the semi-flexible sheet 102 is radially collapsed into a cylindrical shape, the angled apertures 122 are in contact with one another. Thus, the angled apertures 122 are completely closed when the semi-flexible sheet 102 is radially collapsed into the cylindrical shape. The semi-flexible sheet 102 further comprises ribs 160 located on at least one surface of the semi-flexible sheet, where the ribs 160 aid the semi-flexible 102 sheet in radially collapsing into the cylindrical shape. Additionally, the ribs 160 inhibit axial movement of the roll of paper product 200, while allowing the roll of paper product 200 to be dispensed.

Figure 8A:
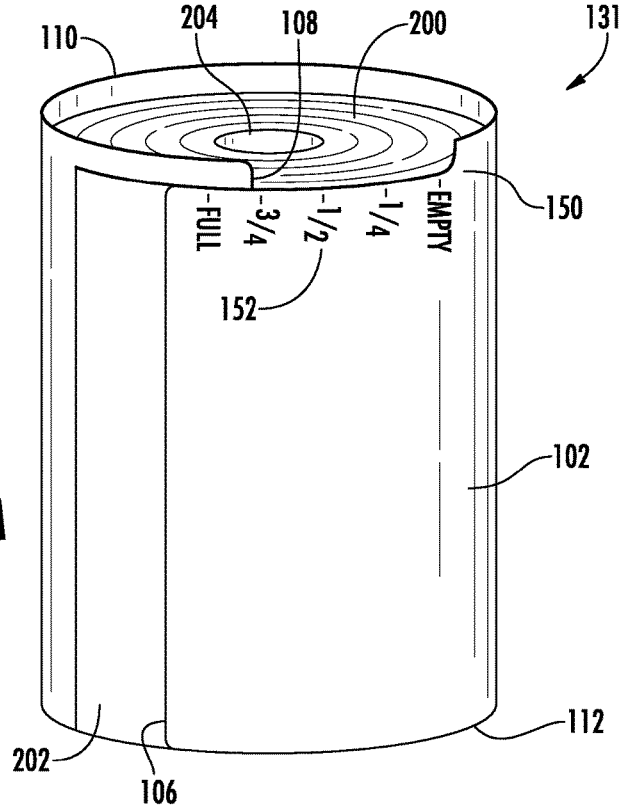
FIG. 8A is a perspective view of an embodiment of the apparatus, in accordance with one embodiment of the present invention.

FIG. 8A illustrates a perspective view of an embodiment of the apparatus 131, in accordance with one embodiment of the present invention. The apparatus illustrated includes a semi-flexible sheet 102 with a leading end 106 a distal end 108, a first side edge 110, and a second side edge 112. The semi-flexible sheet 102 is manufactured such that it is capable of being radially collapsible into a cylindrical shape or other shape over a roll of paper product 200. As illustrated, the roll of paper product 200 includes an inner core 204. When the semi-flexible sheet 102 is radially collapsed into a cylindrical shape, the leading end 106 overlays the distal end 108 and a portion of the semi-flexible sheet 102. The semi-flexible sheet 102 may include markings 152 within a reference notch 150, indicating the capacity of the roll of paper product 200. As paper product 202 is removed, the cylindrical shape made by the semi-flexible sheet 102 reduces in diameter and the distil edge 108 travels radially with the cylindrical shape. The markings 152 indicating the capacity of the paper product 202 may be positioned such that the distil edge 108 indicates the actual capacity of the paper product 202.

Figure 8B:
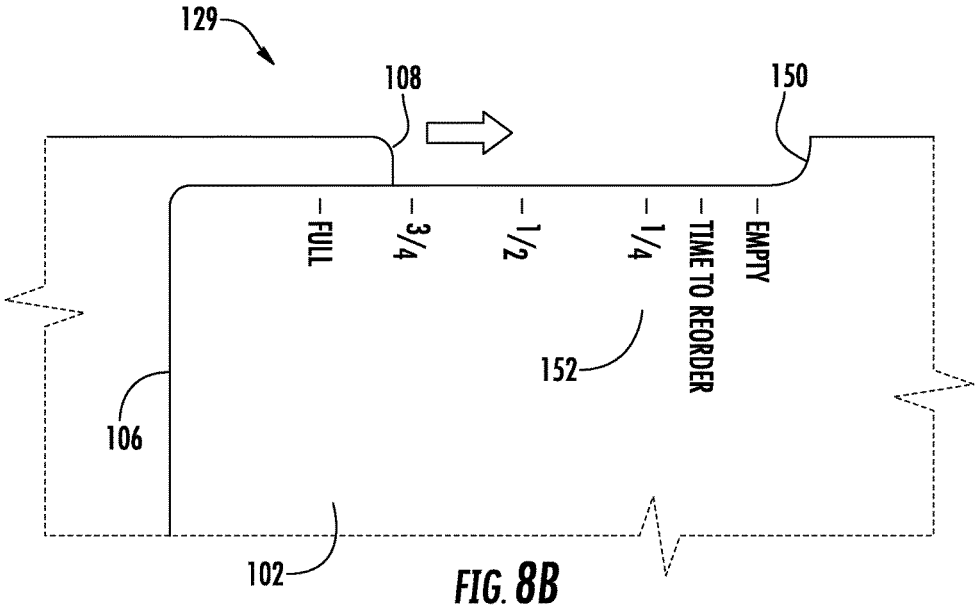
FIG. 8B is an expanded view of an embodiment of the apparatus, in accordance with one embodiment of the present invention.

FIG. 8B is an exploded perspective view of an embodiment of the apparatus 129, in accordance with one embodiment of the present invention. As illustrated, the semi-flexible sheet 102 with reference notch 150 is illustrated. In this way, when the leading end 106 and the distal end 108 compress radially upon the use of one or more sheets of material. The semi-flexible sheet 102 may include markings 152 that illustrate, upon use, the amount of material remaining on the roll of material.

Figure 9A:
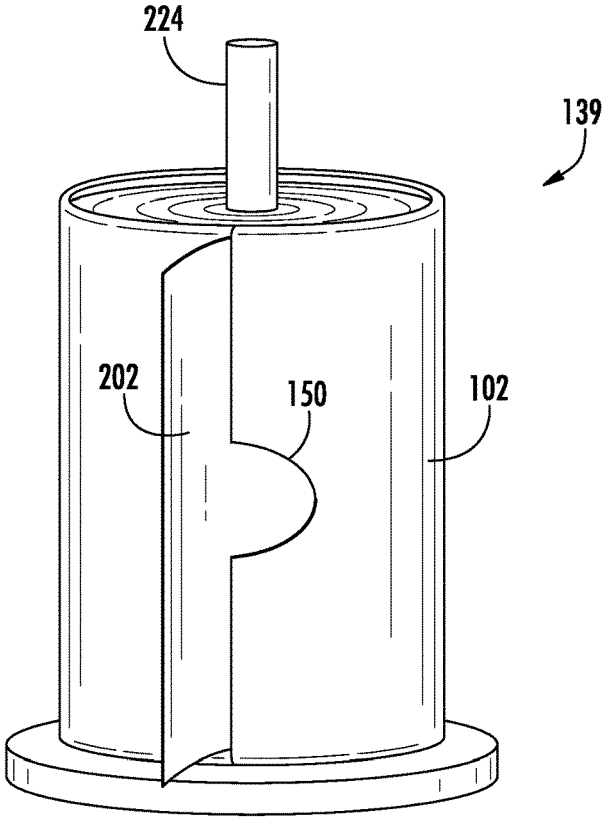
FIG. 9A is a perspective view of an embodiment of the apparatus supported by a holder, in accordance with one embodiment of the invention.
Figure 9B:
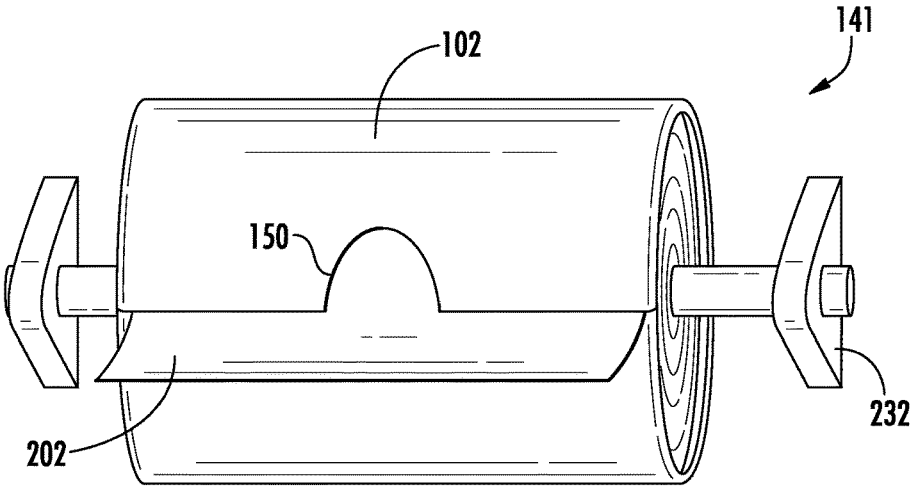
FIG. 9B is a perspective view of an embodiment of the apparatus supported by a holder, in accordance with one embodiment of the invention.

FIGS. 9A-9B illustrate an apparatus 139 operating in conjunction with a holder 224. FIG. 9A illustrates a perspective view of an embodiment of the apparatus supported by a holder 139, in accordance with one embodiment of the present invention. The core of the paper product allow for the passage of a holder 224 of some type.

FIG. 9B illustrates perspective view of an embodiment of the apparatus supported by a holder 141, in accordance with one embodiment of the present invention In yet other embodiments of the invention, besides providing protection to the roll of sheet material 200, the invention increases portability of the roll of sheet material 200 when the semi-flexible sheet 102 is radially collapsed over the roll of sheet material 200. When the semi-flexible sheet 102 is radially collapsed over the roll of sheet material 200, the semi-flexible sheet 102 applies a constant pressure over the roll of sheet material 200, thus preventing the roll of sheet material 200 from unwinding. In some embodiments, the semi-flexible sheet may be configured to receive end caps.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. An apparatus for protecting and dispensing sheet material, the apparatus comprising a semi-flexible sheet having:

a leading end and a distal end, wherein the semi-flexible sheet is partially tapered in width from the leading end to the distal end;

a first side edge and a second side edge, wherein the first side edge comprises a first attachment means adjacent to the leading end for releasably attaching to a portion of the first side edge closer to the distal end of the semi-flexible sheet, and wherein the second side edge comprises a second attachment means adjacent to the leading end for releasably attaching to a portion of the second side edge closer to the distal end of the semi-flexible sheet, wherein the first side edge and the second side edge form a cylindrical shape about a roll of sheet material, and wherein the semi-flexible sheet is radially collapsible around the roll of sheet material upon removal of a portion of the sheet material.

2. The apparatus of claim 1, wherein the attachment means comprises a J shaped clip, wherein one clip is connected to the first side edge proximate to the leading end and a second clip is connected to the second side edge proximate to the leading end, wherein the clips are directed inward towards the semi-flexible sheet to receive and releasably attached the first side edge and the second side edge proximate to the distal end.

3. The apparatus of claim 1, wherein a height of the leading end of the semi-flexible sheet is at least equal to or greater than a height of the roll of sheet material, and wherein the height of the distal end is at least equal to or less than the height of the leading end.

4. The apparatus of claim 1, wherein the semi-flexible sheet further comprises at a first end cover attached perpendicularly to the first side edge and a second end cover attached perpendicularly to the second side edge, wherein the first and second end cover covers at least a portion of an end of a roll of sheet material, wherein the first and second end cover comprises angled spaces configured to prevent the end cover from binding when the semi-flexible sheet is radially collapsed.

5. The apparatus of claim 1, wherein the semi-flexible sheet further comprises ribs that are positioned on at least one surface of the semi-flexible sheet, wherein the ribs are positioned to inhibit axial travel of the roll of sheet material and allow the sheet material to be dispensed.

6. The apparatus of claim 1, wherein the length of the semi-flexible sheet from the distal end to the leading end is greater than a circumference of the roll of sheet material.

7. The apparatus of claim 1, wherein the semi-flexible sheet comprises a plastic material.

8. The apparatus of claim 1, wherein the semi-flexible sheet further comprises a notch located on the leading end, wherein the notch allows for grasping of the sheet material compressed between an overlay created by the leading end and the distal end, and wherein when the semi-flexible sheet is radially collapsed, the notch reveals the sheet material.

9. The apparatus of claim 1, wherein the leading end of the semi-flexible sheet further comprises a gripping surface directed towards the sheet material when the semi-flexible sheet is radially collapsed, wherein the gripping surface is a series of serrations.

10. The apparatus of claim 9, wherein the gripping surface allows passage of the sheet material past the gripping edge when force is applied to the sheet material perpendicular to a front surface of the leading end, and wherein the gripping surface grips the sheet material when force is applied to the sheet material perpendicular to the leading end.

11. The apparatus of claim 1, wherein the sheet material is a disposable paper product.

12. The apparatus of claim 1, wherein the apparatus provides environmental protection to the roll of sheet material, wherein environmental protection comprises at least moisture protection, dust protection, and abrasion protection.

13. An apparatus for protecting and dispensing sheet material comprising a semi-flexible sheet having:

a leading end and a distal end, wherein the leading end of the semi-flexible sheet further comprises a notch located along a center of the leading end;

a first side edge and a second side edge, wherein the semi-flexible sheet is radially collapsible upon a roll of sheet material such that the first side edge and the second side edge form a cylindrical shape about the roll of sheet material, wherein upon radially collapsing upon the roll of sheet material the leading end overlays the distal end and a portion of the semi-flexible sheet such that a portion of the roll of sheet material is compressed between the overlaid leading end and distal end, wherein when the semi-flexible sheet is radially collapsed, the notch reveals the sheet material and allows for grasping of sheet material; and a gripping surface located along at least a portion of the leading end, wherein the gripping surface is configured to allow travel of the sheet material when pulled tangentially to the leading end without damaging the sheet material, and wherein the gripping surface is configured to grip the material when pulled perpendicularly to the leading end.

14. The apparatus of claim 13, wherein the first side edge and the second side edge comprise attachment means adjacent to the leading end for releasably attaching to a portion of the semi-flexible sheet.

15. The apparatus of claim 13, wherein the sheet material is a disposable paper product.

16. The apparatus of claim 13, wherein the leading end of the semi-flexible sheet further comprises a top surface, a bottom surface, and a front surface, wherein the top surface integrates into the semi-flexible sheet, wherein the front surface defines the leading end of the semi-flexible sheet, and wherein the bottom surface comprises the gripping surface that collapses upon a portion of the semi-flexible sheet when radially collapsed, wherein the gripping surface is a series of semi-ridged plastic serrations.

17. The apparatus of claim 13, wherein the semi-flexible sheet is made of a plastic material.

18. The apparatus of claim 13, wherein the apparatus provides environmental protection to the roll of sheet material, wherein environmental protection comprises at least moisture protection, dust protection, and abrasion protection.

19. The apparatus of claim 13, wherein the semi-flexible sheet further comprises at a first end cover attached perpendicularly to the first side edge and a second end cover attached perpendicularly to the second side edge, wherein the first and second end cover covers at least a portion of an end of a roll of sheet material, wherein the first and second end cover comprises angled spaces configured to prevent the end cover from binding when the semi-flexible sheet is radially collapsed.

* * * * *